US011565878B1

(12) United States Patent
Earley

(10) Patent No.: US 11,565,878 B1
(45) Date of Patent: Jan. 31, 2023

(54) GARBAGE BIN SUPPORT MEMBER

(71) Applicant: Damian Earley, Columbus, OH (US)

(72) Inventor: Damian Earley, Columbus, OH (US)

( * ) Notice: Subject to any disclaimer, the term of this patent is extended or adjusted under 35 U.S.C. 154(b) by 0 days.

(21) Appl. No.: 17/498,021

(22) Filed: Oct. 11, 2021

(51) Int. Cl.
*B65F 1/14* (2006.01)

(52) U.S. Cl.
CPC ..... *B65F 1/141* (2013.01)

(58) Field of Classification Search
None
See application file for complete search history.

(56) References Cited

U.S. PATENT DOCUMENTS 1,598,135 A * 8/1926 Heinson ..... B65F 1/141 248/154
4,048,938 A * 9/1977 Patterson, III ..... B63B 25/28 403/43
6,488,253 B1 * 12/2002 Piccolomini ..... B65F 1/141 24/601.5
8,777,206 B1 * 7/2014 Airosa ..... B44D 3/14 248/500
10,850,920 B1 * 12/2020 Allen ..... B62B 5/0093
10,906,698 B2 * 2/2021 McCrossin ..... B62B 5/049
2004/0206758 A1 * 10/2004 Lin ..... B65F 1/163 220/263
2014/0110911 A1 * 4/2014 O'Connor ..... B65F 1/1473 280/755

* cited by examiner

*Primary Examiner* — Steven M Marsh
(74) *Attorney, Agent, or Firm* — Cantor Colburn LLP

(57) ABSTRACT

A garbage bin support system includes a base member having a substantially planar horizontal surface and a hook assembly including a hook support projecting outwardly from the substantially planar horizontal surface and a hook element pivotally connected to the hook support. The hook element is configured and disposed to engage an axle of a garbage bin to prevent tipping from the base member.

11 Claims, 2 Drawing Sheets

GARBAGE BIN SUPPORT MEMBER

BACKGROUND OF THE INVENTION

Exemplary embodiments pertain to the art of garbage cans and, more particularly, to a garbage bin support member that captures and retains a garbage bin.

Trash cans or garbage bins, whichever you prefer, are ubiquitous in modern society. On pick up day in many suburban neighborhoods, streets are lined with wheeled garbage cans awaiting pickup. Many people will put their garbage can out a night before being pick up. That is, in some cases, pick up can come early and it is more efficient to put cans out in the evening the night before. As such, garbage cans may be exposed to various weather conditions including rain, snow, and wind. When exposed to wind, a garbage can may be blown over spilling contents all over the street. Toppling is particularly prevalent with wheeled garbage cans. Wheeled garbage cans typically include a narrow wheel base. The narrow wheel base makes the garbage can unstable.

BRIEF DESCRIPTION OF THE INVENTION

Disclosed is a garbage bin support system including a base member having a substantially planar horizontal surface and a hook assembly including a hook support projecting outwardly from the substantially planar horizontal surface and a hook element pivotally connected to the hook support. The hook element is configured and disposed to engage an axle of a garbage bin to prevent tipping from the base member.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
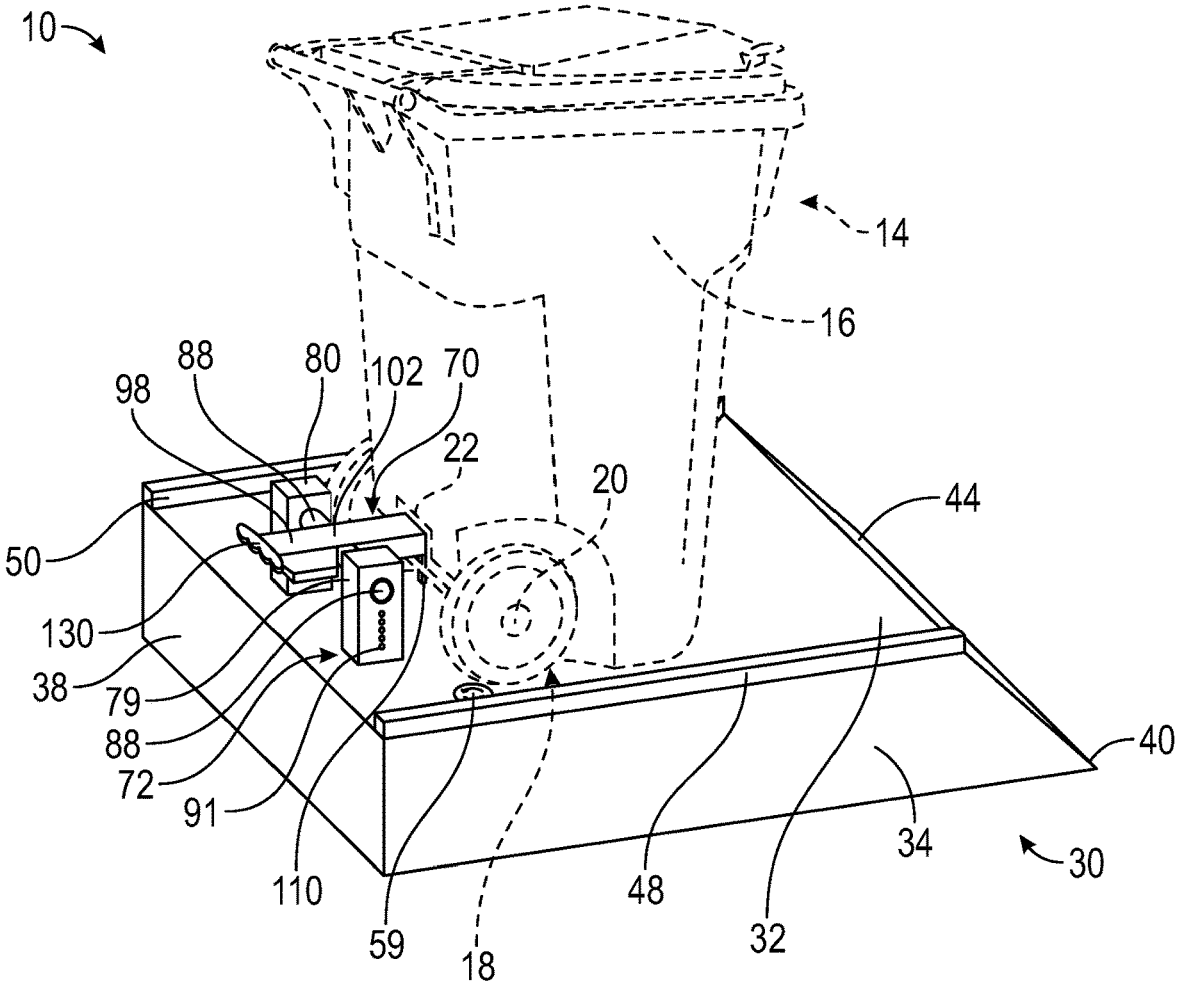
FIG. 1 depicts an upper right rear view of a garbage bin on a garbage bin support system, in accordance with a non-limiting example.

A garbage bin support system, in accordance with a non-limiting example, is indicated at 10 in FIG. 1. Garbage bin support system 10 supports and prevents toppling of a garbage bin 14 having a body 16 supported on a pair of wheels 18 coupled to an axle 20. A portion of axle 20 is exposed to ambient via a recess 22 formed in body 16. Garbage bin 14 rests upon and is retained on garbage bin support system 10 as will be detailed herein.

Figure 2:
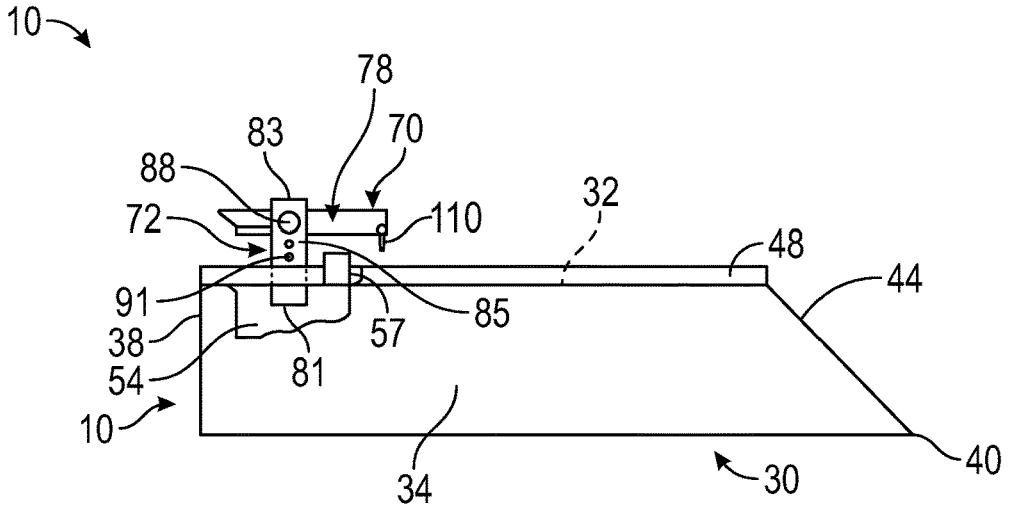
FIG. 2 depicts a right side elevational view of the garbage bin support system of FIG. 1, in accordance with a non-limiting example.
Figure 3:
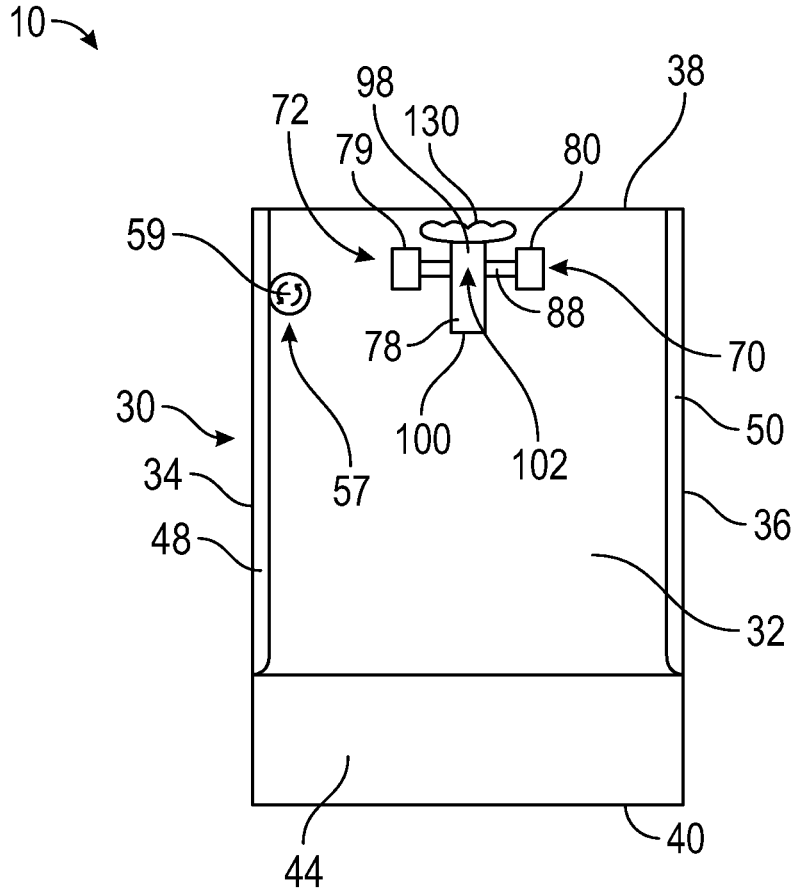
FIG. 3 depicts a top view of the garbage bin support system of FIG. 1, in accordance with a non-limiting example.

Referring to FIGS. 2 and 3 and with continued reference to FIG. 1, garbage bin support system 10 includes a base member 30 including a substantially planar horizontal surface 32 that configured to support garbage bin 14. Base member 30 includes a first side 34, a second side 36, a rear side 38 and a forward side 40. A ramp 44 is provided on forward side 40. Ramp 44 includes a surface (not separately labeled) angling downwardly from substantially planar surface 32. First side 34 includes a first side wall 48 and second side 36 includes a second side wall 50. First side wall 48 and second side wall 50 project upwardly from substantially planar horizontal surface 32 and act as a guide for aligning garbage bin 14.

Base member 30 may include a ballast receiving zone 54 or hollow interior. Ballast receiving zone 54 may be filed with sand, pebbles, water, or some other form of ballast that enhances an overall stability of base member 30. Ballast receiving zone 54 includes a fill opening 57 that may project upwardly from substantially planar horizontal surface 32. Fill opening 57 may be provided with a cap 59.

Figure 4:
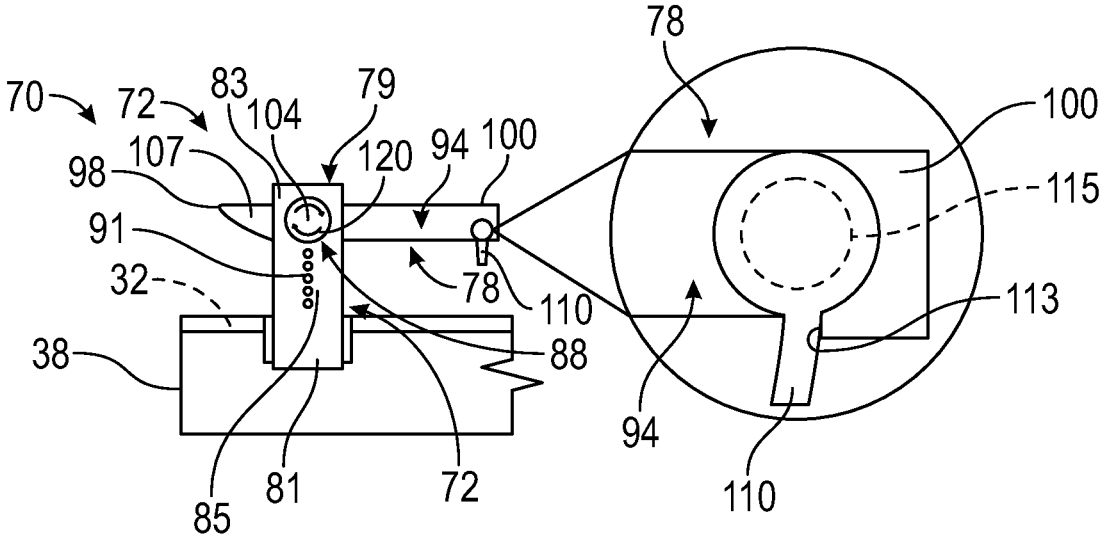
FIG. 4 is a partial side view of a hook assembly of the garbage bin support system of FIG. 1, in accordance with a non-limiting example.

Garbage bin support system 10 includes a hook assembly 70 that selectively engages with axle 20 to retain garbage bin 16. In accordance with a non-limiting example, hook assembly 70 includes a hook support 72 and a hook element 78. Hook support 72 may include a first support member 79 and a second support member 80. Reference will follow to FIG. 4 in describing first support member 79 with an understanding that second support member 80 includes similar structure. First support member 79 includes a first end portion 81, a second end portion 83, and an intermediate portion 85. A pivot support or axle 88 is defined adjacent second end portion 83. Pivot support 88 may extend through openings (not separately labeled) formed in first support member 79 and second support member 80. Intermediate portion 85 also includes a number of adjustment elements 91 that may establish a selected height of second end portion 83 relative to substantially planar surface 32.

In accordance with a non-limiting example, hook element 78 takes the form of a beam 94 that is mounted between first support member 79 and second support member 80 and selectively rotates about pivot support 88. Beam 94 includes a first end 98, an opposing second end 100, and a support section 102 that that receives pivot support 88 and defines a pivot axis 104 that is substantially perpendicular to beam 94. First end 98 defines a pedal or foot actuator 107 and second end 100 supports a pin element 110. Pin element 110 may rotate relative to second end 100. Beam 94 includes a travel limiter 113 that limits a rotational path of pin element 110. A biasing element 115, such as a spring, urges pin element 110 toward travel limiter 113. A biasing member 120 is arranged about pivot axis 104 and urges second end 100 or beam toward substantially planar surface 32.

With this arrangement, pin element 110 may deflect toward rear side 38 to promote insertion of second end 100 into recess 22. Once inserted, biasing element 115 urges pin element 110 to rotate back to travel limiter 113 and hook axle 20. Once hooked, garbage can 16 is secured to base member 30 and be supported so as to prevent toppling due to external forces such as wind and the like. In this manner, a homeowner will be less likely to be forced to clean up trash spilled from the garbage can. Further, while described as being filled with a ballast material, the base member may be rested upon a supporting surface or secured to the supporting surface with mechanical fasteners.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A garbage bin support system comprising:

a base member including a substantially planar horizontal surface; and a hook assembly including a hook support projecting outwardly from the substantially planar horizontal surface and a hook element including a beam pivotally mounted to the hook support, the beam including a first end and a second end including a pin element pivotally mounted to and extending outwardly from the beam, the beam including a travel limiter that constrains pivotal movement of the pin element, the pin element including a biasing element arranged at the second end of the beam, the biasing element urging the pin element toward the travel limiter, the hook element being configured and disposed to engage an axle of a garbage bin to prevent tipping from the base member.

2. The garbage bin support system according to claim 1, wherein the beam includes a pivot axis defined between the first end and the second end.

3. The garbage bin support system according to claim 2, wherein the first end of the beam defines a pedal.

4. The garbage bin support according to claim 1, wherein the beam includes a biasing member that urges the second end toward the substantially planar horizontal surface.

5. The garbage bin support according to claim 1, wherein the hook support includes a plurality of adjustment elements that establish a selected height of the hook element relative to the substantially planar horizontal surface.

6. The garbage bin support according to claim 1, wherein the base member includes a ramp angling downwardly from the substantially planar horizontal surface.

7. The garbage bin support system according to claim 1, wherein the base member includes a first side wall and a second side wall extending upwardly from the substantially planar horizontal surface, the first side wall and the second wall defining guide members that direct a garbage bin toward the hook assembly.

8. A garbage bin support system comprising:

a base member including a substantially planar horizontal surface; and a hook assembly including a hook support projecting outwardly from the substantially planar horizontal surface and a hook element pivotally connected to the hook support, the hook element being configured and disposed to engage an axle of a garbage bin to prevent tipping from the base member, wherein the base member includes a ballast receiving zone configured to receive an amount of ballast material for stabilizing the garbage bin support system.

9. The garbage bin support system according to claim 8, further comprising: a fill opening connected to the ballast receiving zone.

10. The garbage bin support system according to claim 9, wherein the fill opening extends through the substantially planar horizontal surface, the fill opening including a selectively removable cap.

11. The garbage bin support system according to claim 1, further comprising: a carry handle arranged on the base member.

* * * * *